US011259982B2

(12) United States Patent
Ognibene et al.

(10) Patent No.: US 11,259,982 B2
(45) Date of Patent: Mar. 1, 2022

(54) TREADMILL ATTACHMENT FOR ANTI-GRAVITY SUSPENSION SYSTEM

(71) Applicants: Ryan Charles Ognibene, Boulder, CO (US); Bradley Thomas Miles, Superior, CO (US); James Warren Hurt, III, Boulder, CO (US)

(72) Inventors: Ryan Charles Ognibene, Boulder, CO (US); Bradley Thomas Miles, Superior, CO (US); James Warren Hurt, III, Boulder, CO (US)

( * ) Notice: Subject to any disclaimer, the term of this patent is extended or adjusted under 35 U.S.C. 154(b) by 14 days.

(21) Appl. No.: 16/858,570

(22) Filed: Apr. 24, 2020

(65) Prior Publication Data

US 2020/0337935 A1 Oct. 29, 2020

Related U.S. Application Data

(60) Provisional application No. 62/838,588, filed on Apr. 25, 2019.

(51) Int. Cl.

| | |
|---|---|
| ***A61H 3/00*** | (2006.01) |
| ***A63B 22/02*** | (2006.01) |
| ***A63B 21/055*** | (2006.01) |
| ***A63B 21/04*** | (2006.01) |
| ***A63B 21/00*** | (2006.01) |
| ***A63B 21/065*** | (2006.01) |
| *A63B 71/06* | (2006.01) |

(52) U.S. Cl.

CPC ..... *A61H 3/008* (2013.01); *A63B 21/0442* (2013.01); *A63B 21/0557* (2013.01); *A63B 21/065* (2013.01); *A63B 21/155* (2013.01); *A63B 21/4009* (2015.10); *A63B 22/02* (2013.01); *A61H 2201/5043* (2013.01); *A63B 2071/065* (2013.01)

(58) Field of Classification Search

CPC ..... A61H 1/0229; A61H 1/00; A61H 3/008; A61H 2201/5043; A61H 2201/163; A61H 2201/1261; A61H 2201/0192; A61H 2201/0157; A63B 21/00181; A63B 21/0442; A63B 21/0557; A63B 21/065; A63B 21/058; A63B 21/155; A63B 21/156; A63B 21/4009; A63B 21/4043; A63B 21/00047; A63B 21/00178; A63B 22/02; A63B 69/0064; A63B 2071/065; A63B 2071/0622

See application file for complete search history.

(56) References Cited

U.S. PATENT DOCUMENTS

| | | | | |
|---|---|---|---|---|
| 6,554,747 | B1 * | 4/2003 | Rempe | A63B 21/04 482/38 |
| 6,742,523 | B2 | 6/2004 | Dubats | |
| 7,381,163 | B2 | 6/2008 | Gordon et al. | |
| 7,494,450 | B2 | 2/2009 | Solomon | |
| 7,998,040 | B2 | 8/2011 | Kram et al. | |
| 8,267,838 | B2 | 9/2012 | Rasmussen | |

(Continued)

*Primary Examiner* — Megan Anderson

(57) ABSTRACT

A lightweight, mobile treadmill attachment designed for effective weight reduction, anti-gravity suspension is disclosed. The treadmill attachment provides a system in which an elastic cord is suspended within a frame that attaches to the arms of a treadmill. The elastic cord imparts an equalized lifting force throughout the suspension system by a rope camming system to a user to provide an effective weight loss and anti-gravity functionality.

17 Claims, 5 Drawing Sheets

(56) References Cited

U.S. PATENT DOCUMENTS

| | | | | |
|---|---|---|---|---|
| 8,608,479 | B2 | 12/2013 | Liu | |
| 8,663,133 | B2 | 3/2014 | Johnson et al. | |
| 8,920,347 | B2 * | 12/2014 | Bayerlein | A63B 21/00181 601/35 |
| 9,370,680 | B1 | 6/2016 | Macaulay et al. | |
| 9,421,144 | B2 | 8/2016 | Kalinowski | |
| 9,433,817 | B2 | 9/2016 | Toback et al. | |
| 9,498,696 | B1 | 11/2016 | Razon | |
| 9,675,838 | B2 | 6/2017 | Manzke et al. | |
| 9,801,775 | B2 | 10/2017 | Vallery et al. | |
| 9,914,003 | B2 | 3/2018 | Kuehne et al. | |
| 10,265,565 | B2 | 4/2019 | Jue et al. | |
| 10,500,122 | B2 | 12/2019 | Aryananda et al. | |
| 10,799,409 | B2 | 10/2020 | Rydstrom et al. | |
| 10,918,926 | B2 | 2/2021 | Pennington | |
| 2012/0197168 | A1 * | 8/2012 | Agrawal | A63B 23/047 602/19 |
| 2020/0037926 | A1 | 2/2020 | Tomczak | |
| 2020/0230005 | A1 | 7/2020 | Hidler | |
| 2020/0337935 | A1 | 10/2020 | Ognibene et al. | |
| 2021/0005319 | A1 * | 1/2021 | Otsuki | A61B 5/4585 |
| 2021/0030615 | A1 | 2/2021 | Belforte et al. | |
| 2021/0113418 | A1 | 4/2021 | Matsumoto et al. | |

* cited by examiner

TREADMILL ATTACHMENT FOR ANTI-GRAVITY SUSPENSION SYSTEM

PRIORITY

This utility application claims the benefit of U.S. Provisional Patent Application No. 62/838,588, filed on Apr. 25, 2019; the entirety of the provisional patent application is hereby incorporated by reference.

FIELD OF THE INVENTION

This invention relates to treadmills. More particularly, it relates to an anti-gravity suspension system for use with a treadmill.

BACKGROUND

Athletes and physical therapy patients often need a device that can effectively reduce their body weight while exercising on treadmills. The effective reduction in body weight is beneficial for treadmill users for fitness purposes and in particular is beneficial for users that have injuries or are in recovery from injuries.

There are several devices that are currently available for effectively reducing body weight while exercising on a treadmill or similar piece of exercise equipment. One available device option is an entire treadmill system that uses air pressure to provide anti-gravity functionality. Another device option is an anti-gravity system that is fixed around a treadmill and/or under the bottom of a treadmill. These devices can be cumbersome, are generally stationary (not readily mobile), and do not allow a user to move about freely within the device.

Accordingly, there is a need in the art for a weight-reduction device that can readily be transported from one location to another for use on a treadmill. Further, there is a need for such a device to be configured for simple, quick and convenient setup on a treadmill or on an adapter stand that supports the device over a treadmill. Moreover, there is a need for a device that allows a user to move freely within the device while maintaining effective weight reduction, anti-gravity functionality. The presently disclosed treadmill attachment for anti-gravity suspension addresses these needs.

SUMMARY

The presently disclosed treadmill attachment for effective body weight reduction and anti-gravity suspension includes a frame assembly that attaches to the arms of a treadmill or to a support adaptor for use with a treadmill. An elastic cord is suspended within the frame assembly, and indirectly attaches to a user of the treadmill attachment to impart an upward lifting motion or anti-gravity functionality to the user. The upward force imparted by the elastic cord is equalized throughout the elastic cord to provide an equalized anti-gravity functionality.

In a preferred embodiment, the frame assembly has horizontal first and second cross members that attach to vertical support members that in turn attach to horizontal base members. Accordingly, the front and rear cross members are held in an elevated position above and extended out from the base members, with the cross members being oriented perpendicular to the base members.

The elastic cord that is suspended within the frame is attached to a first side of the first cross member, runs back to the second cross member, and then runs forward to a second side of the first cross member. The elastic cord is held in a stationary position or adjustable point of attachment on the first side of the front member, can freely move through one or more points of attachment on the second cross member, and is held in an adjustable position on the second side of the first cross member. In this fashion, the length of the elastic cord can readily be adjusted to lengthen or shorten the amount of elastic cord that is suspended in the frame assembly, thereby adjusting the amount of effective weight reduction and/or the height of the elastic cord.

The elastic cord is fed through right and left side pulley wheels coupled to a user's legs apparel to support the user at about a midpoint between the front and rear cross bars. The pulley wheels are suspended by the elastic cord, and allow for movement of the wheels about the elastic cord. This movement in combination with the movement afforded the elastic cord by rear cross bar point(s) of attachment allows a user to freely move frontward, backward, and side to side within the treadmill attachment device.

The preceding and following embodiments and descriptions are for illustrative purposes only and are not intended to limit the scope of this disclosure. Other aspects and advantages of this disclosure will become apparent from the following detailed description.

DETAILED DESCRIPTION

Figure 1:
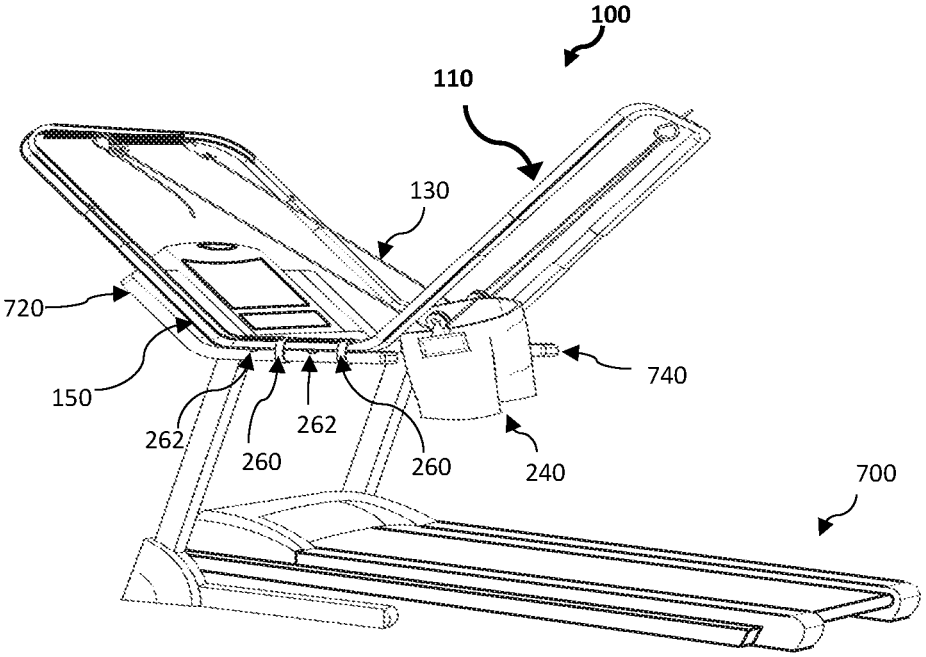
FIG. 1 is an illustrated view of an exemplary treadmill attachment shown in FIG. 2 attached to a treadmill.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

The presently disclosed device for use with a treadmill provides for effective weight reduction and an anti-gravity functionality as detailed herein. In a preferred embodiment, the device readily attaches to the arms of a treadmill and provides lift to a user of the treadmill, thereby providing an effective reduction in weight. In an alternative embodiment, the device readily attaches to an adaptor stand that positions the device over a treadmill for use.

In a preferred embodiment, the treadmill attachment device has a frame that supports an effective weight reduction/anti-gravity system that lies within the frame. The frame has two opposing base bars that are configured to attach to the arms of a treadmill or an adaptor stand to allow the frame to bridge the treadmill. Extending both forward and aft of the base bars are angled support bars that rise up from the base bars to support elevated cross bars that bridge across the ends of the support bars. Accordingly, there is a front cross bar and a rear cross bar, with the front cross bar facing the front of a treadmill, and the rear cross bar facing the rear of a treadmill. The frame therefore has two base bars that lie on opposite sides of a treadmill (or adaptor stand), with each bar having a front end and rear end. Two opposing front support arms extend from the front ends of the base bars, and two opposing rear support arms extend from the rear of the base bars. A front cross bar connects to the upward ends of the front support arms, and a rear cross bar connects to the upward ends of the rear support arms.

Attached to the frame are the inner parts of the treadmill attachment device. These parts include an elastic cord or bungee cord that extends from a first half of the front cross bar to a rear support point or points centered about the center of the rear cross bar, and from the rear support point(s) the elastic cord continues to extend to a second half of the front cross bar. Accordingly, a single elastic cord extends from the front of the device to the rear of the device and then back to the front of the device to form a generally V or U shaped cord when viewed from above.

In a preferred embodiment, the elastic cord is fixedly or adjustably attached to a first, front point of attachment on a first side of the front cross bar, extends back to and through a ring or pulley structure at the center of the back cross bar, and extends forward to and through an adjustable point of attachment on a second side of the front cross bar that allows for adjustment of the length of the elastic cord. The first and second side points of attachment of the elastic cord to the front cross bar are centered about the front cross bar, such that each point of attachment is equidistant from the center of the cross bar. The width between the first and second side points of attachment typically is about the width of the distance between a user's hips so as to allow a user to comfortably stand between two central points of the elastic cord that are centered between the front and rear cross bars.

The point of attachment of the elastic cord on either side of the front cross bar or on both sides is adjustable to allow the length of the elastic cord in the device to be shortened or lengthened as needed for a given individual's height and desired effective weight reduction. The adjustable elastic cord length allows the effective weight reduction to be adjusted from no weight to a desired amount of effective weight reduction.

In a preferred embodiment, the elastic cord passes through two or more fasteners on the rear cross bar that allow the cord to freely move through the fasteners. The two or more fasteners are centered about the center of the rear cross bar. In another embodiment, the position of the two or more rear fasteners can be adjustable, such that they can move from side to side along the rear cross bar. In this configuration, the position of the rear fasteners can be adjusted to provide the system with greater flexibility in accommodating users having different body widths. Likewise, the position of the front fasteners can be adjustable as well to further add to the flexibility of the system with respect to different widths of distances between the hips of different users.

As the elastic cord travels from the front cross bar to the rear cross bar and back to the front cross bar, it feeds through freely moving support devices that are approximately midway between the front and rear cross bars. These freely moving support devices are attached to a pair of shorts or pants worn by a user of the device. The elastic cord runs through the freely moving support devices, through which the elastic cord exerts the upward force that produces the effective weight reduction by the treadmill attachment device. Accordingly, the elastic cord is suspended between the front and rear cross bars and is attached to a user of the device midway between the front and rear cross bars to yield an upward, anti-gravity force to the user.

The freely moving support devices through which the elastic cord runs through allows forward and rearward movement of the devices relative to the elastic cord. This movement accounts for the forward and rearward movement of a user's body as a user either walks or runs while using the treadmill attachment device. In addition, the elastic cord in combination with the freely moving support devices allows for freedom of movement from side to side that can naturally occur as a user walks or runs.

The freely moving support devices are preferably permanently attached to or integrated into a pair of shorts or pants worn by a user. Alternatively, the freely moving support devices may be removably attached to the user's leg garments through a readily engaged and subsequently released fastening system. In this manner, the user's leg garments may be attached to the freely moving support devices by buttons, snaps, hook and loop fasteners, and the like.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternative embodiments, additional devices, or combinations of illustrated devices, may be added to, or combined, without limiting the scope to the embodiments disclosed herein.

Referring to FIG. 1, an exemplary embodiment of a treadmill attachment 100 designed for anti-gravity suspension is shown attached to a treadmill 700. The treadmill attachment 100 is attached to the treadmill 700 by resting the frame 110 of the treadmill attachment 100 on the arms 720 and 740 of the treadmill 700, and then strapping the treadmill attachment 100 to the arms 720 and 740 by straps 260 (the straps that attach to arm 740 are not visible in this view). As detailed below, the treadmill attachment 100 provides lift to a user of a treadmill, thereby providing an anti-gravity, effective weight suspension system.

Figure 2:
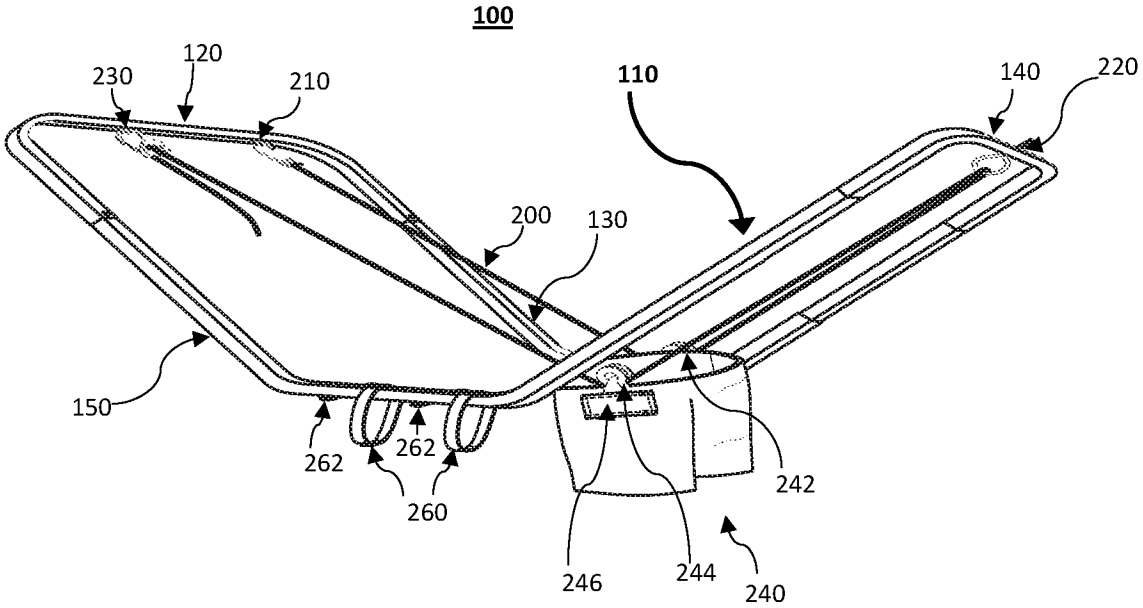
FIG. 2 is an illustrated view of a preferred embodiment of an exemplary treadmill attachment.

Turning to FIG. 2, a preferred embodiment of a treadmill attachment 100 is shown detached from a treadmill. The preferred treadmill attachment device 100 as shown has a frame 110 that is assembled from four members (typically made from bars) that include two (2) side base and angled support arm bars 130, 150, and two (2) cross bars, a first or front bar 120, and a second or rear bar 140. In this preferred, nonlimiting configuration, the above described base and angled support bars are integrated into a single bar having a front extending, angled support bar; a horizontal base bar; and a rear extending, angled support bar.

The outer frame 110 provides support for an inner suspended system that includes an elastic cord 200, attachment points at which the cord 200 attaches to or is suspended by the frame 110, and a pair of leg garments, such as shorts 240 that are suspended from the elastic cord by pulleys 242 and 244. The attachment points for the cord includes a first front attachment point 210 on front cross bar 120; a first rear attachment point 220 on rear cross bar 220; and a second front attachment point 230 on front cross bar 120. Accordingly, the elastic cord runs from first front attachment point 210 to rear attachment point 220 and then back to second front attachment point 230 to form a loop. The elastic cord 200 is slidably threaded through the rear attachment point 220. In this manner, the elastic cord 200 provides suspension for the shorts 240 worn by a user. The shorts 240 are attached to pulleys 242 and 244 by support straps 246. The elastic cord 200 feeds under the pulleys 242 and 244, thereby suspending the shorts 240 from the elastic cord 200.

The structure of the presently disclosed treadmill attachment provides for an anti-gravity/effective weight reduction effect through an upward lifting force imparted by the elastic cord. As shown in FIG. 2, the suspension structure of the treadmill attachment 100 provides for an equalized upward force throughout the elastic cord 200. This equalized force is achieved through movement of the elastic cord 200 that is allowed throughout the configuration of the treadmill attachment 100. In particular, the configuration allows for the elastic cord to freely move through the attachment point(s) on the rear cross bar, such as that shown in FIG. 2, which includes attachment point 220 on the rear cross bar 140. Movement that is allowed through the attachment of the elastic cord 200 to suspension pulleys 242 and 244 further contributes to the equalization of lifting force throughout the treadmill attachment 100. Accordingly, a user of the treadmill attachment 100 experiences a lifting force that is equalized and balanced between the right and left sides of the user's body. As detailed below, the movement of the elastic cord 200 within the treadmill attachment system 100 further allows a user to freely move forward and backward as well as side to side within the system.

The treadmill attachment device 100 as shown in FIG. 2 has three elastic cord 200 attachment points 210, 220, and 230. The rear cross bar 140 attachment point 220 allows the elastic cord 200 to freely move through the attachment point. The elastic cord 100 can be attached to the rear cross bar 140 through any of a number of fasteners, such as the ring or eyebolt structure shown in FIG. 2. Alternatively, the fastener can be a pulley wheel(s) or any other fastener that allows the elastic cord to move freely through the rear attachment point 220.

The front cross bar 120 attachment points 210 and 230 are equidistant from the center of the front cross bar 120 and securely hold the elastic cord 200 in place during use. One or both of the front cross bar 120 attachment points 210 and 230 may be adjustable with respect to allowing the length of the elastic cord 200 to be adjusted. In this manner, the effective weight loss imparted by the system can be adjusted, as well as allowing for the height of the elastic cord 200 to be adjusted within the system to accommodate users of differing heights. Moreover, the adjustable length of the elastic cord 200 allows for a continuous adjustment of height that is not limited by fixed points of height adjustment, as typically used in other systems.

As shown in the nonlimiting treadmill attachment 100 embodiment in FIG. 2, the front cross bar 120 attachment points for the elastic cord 200 include a fixed attachment point 210 and an adjustable attachment point 230. The adjustable attachment point 230 allows the length of the elastic cord 200 to be adjusted at one end while the fixed attachment point 210 holds the other end in one place. The placement of the adjustable attachment point is arbitrary, such that either attachment point 210 or 230 could be an adjustable attachment point while the other attachment point is fixed. In an alternative embodiment that is not shown, both front cross bar attachment points can be adjustable to allow adjustment of the elastic cord from both sides of the front cross bar.

Throughout this specification, the treadmill attachment is referred to as having an orientation of front and rear ends relative to the treadmill's front and rear ends. It is to be understood that this orientation is provided as such out of convenience, and it not limited to such an orientation. Accordingly, the adjustable fastener(s) could be attached to the rear of the treadmill attachment, and the fastener(s) that allow the elastic cord to move freely could attach to the front of the treadmill attachment The elastic cord 200 can by attached to the frame 110 through any of a number of attachment fasteners or mechanisms. For example, the rear cross bar 140 attachment point 220 can be an eye bolt (as shown), a pulley wheel(s), or any other attachment mechanism that allows the elastic cord to freely move at the rear of the treadmill attachment 100. The front cross bar 120 can include a fixed attachment point at one of the two attachment points for attachment of one end of the elastic cord 200. The stationary attachment of the elastic cord can occur through a hook through an eyebolt as shown in attachment point 210, or any alternative type of fastener that will hold an end of the elastic cord in place. One or both ends of the elastic cord 200 can be attached to the frame 110 by an adjustable fastener. For example, a rope cam 230 as shown in FIG. 2 can be used an adjustable fastener. Alternative fasteners that allow for the length of an end of the elastic cord 200 to be adjusted can likewise be employed as an adjustable fastener. For example, a winch, a one-way bearing wheel, a ratcheting device, and so forth could be employed as an adjustable fastener. Although the elastic cord is illustrated as engaging attachment points on cross bars that are horizontal, it is to be understood that the elastic cord also can engage attachment points on cross bars that are vertical in orientation.

As shown in FIG. 2, an elastic cord 200 attaches to the front cross bar 120 at an attachment point 210 where there is an attachment fastener. The elastic cord then passes through a pulley wheel 242, next threads and passes through a rear attachment point 220, then passes through a pulley wheel 244, and finally passes through the front attachment point 230 where there is an adjustable fastener.

A user attaches to the elastic cord 200 indirectly through the pulleys 242 and 244. The pulley wheels 242 and 244 attach to the user by a configuration in which the pulley wheels 242 and 244 can be permanently attached to the user's leg garment 240 such as by support straps 246 as shown in FIG. 2. Alternatively, the pulley wheels 242 and 244 can be attached to the user's shorts 240 by support straps that are removably attached to the shorts 240 by a hook and loop fastener, buttons, snaps, zippers, and the like. The user's pants or shorts 240 are to be put on by the user prior to use of the treadmill attachment 100.

The pulley wheels 242 and 244 allow a user of the treadmill to freely move while using the treadmill attachment 100. The pulley wheels 242 and 244 can rotate back and forth over the elastic cord 200 to allow the user to move freely with back and forth as well as up and down movement that naturally occurs when a person walks or runs. The flexibility of the elastic cord 200 coupled with the free rotation of the pulley wheel 242 and 244 also allows for freedom of motion from side to side as naturally occurs when a person walks or run. The equalization of upward lifting force throughout the treadmill attachment 100 coupled with the freedom of movement of the elastic cord 200 relative to the pulley wheels 242 and 244 as well as relative to the rear attachment point(s) allows a user to freely move within the treadmill attachment 100.

As shown in FIG. 1, the treadmill attachment 100 can be attached to a treadmill 700 by resting the frame 110 on the arms 720 and 740 of a treadmill. In particular, the horizontal base portion of each of the base/supports 130 and 150 of the frame 110 rests on the arms 720 and 740. The frame is then secured in place by straps 260 that wrap around the arms 720 and 740 of the treadmill 700 (the straps that would wrap around arm 740 are not shown). The straps 260 can be securely closed and fastened around the arms 720 and 740 of the treadmill 700 by any of a number of nonlimiting fasteners, such as straps with holes that feed through a buckle, snaps, hook and loop fasteners, and so forth. The straps 260 themselves can be made of any of a number of materials such as, but not limited to, rubber, nylon, and other materials that impart the strength, flexibility, and durability required for the straps 260 to securely hold the treadmill attachment 100 to the treadmill 700. The stability of the frame 110 on the arms 720 and 740 of the treadmill is further enhanced by flat bars 262 that are perpendicular to the base/angled support bars 130 and 150 so as to provide additional, flat surface area of the frame 110 relative to the arms 720 and 740 of the treadmill 700.

Referring to FIGS. 1 and 2, after a user puts on shorts 240 and is positioned and ready to use the treadmill attachment 100 on the treadmill, the user threads the elastic cord 130 (which is attached to first front attachment point 210) through the first pulley wheel 242, through the rear attachment point 220, through the second pulley wheel 244, and through the second front attachment point 230. This process ties the user's shorts 240 into the treadmill attachment 100 system. Once the user is ready to begin a workout on the treadmill, the user tightens the elastic cord 200 using the rope cam system at front attachment point 230 to a desired tautness and is provided a lifting force such that the user has an effective weight reduction, anti-gravity suspension while workout on the treadmill.

After the user has completed their workout, the user releases the tautness of the elastic cord 200 and is then able to release the elastic cord 200 from the second front attachment point 230, second pulley wheel 244, rear attachment point 220, and first pulley wheel 242 to release the user's shorts 240 from the system, thereby releasing the user from the treadmill attachment 100 system.

Figure 3:
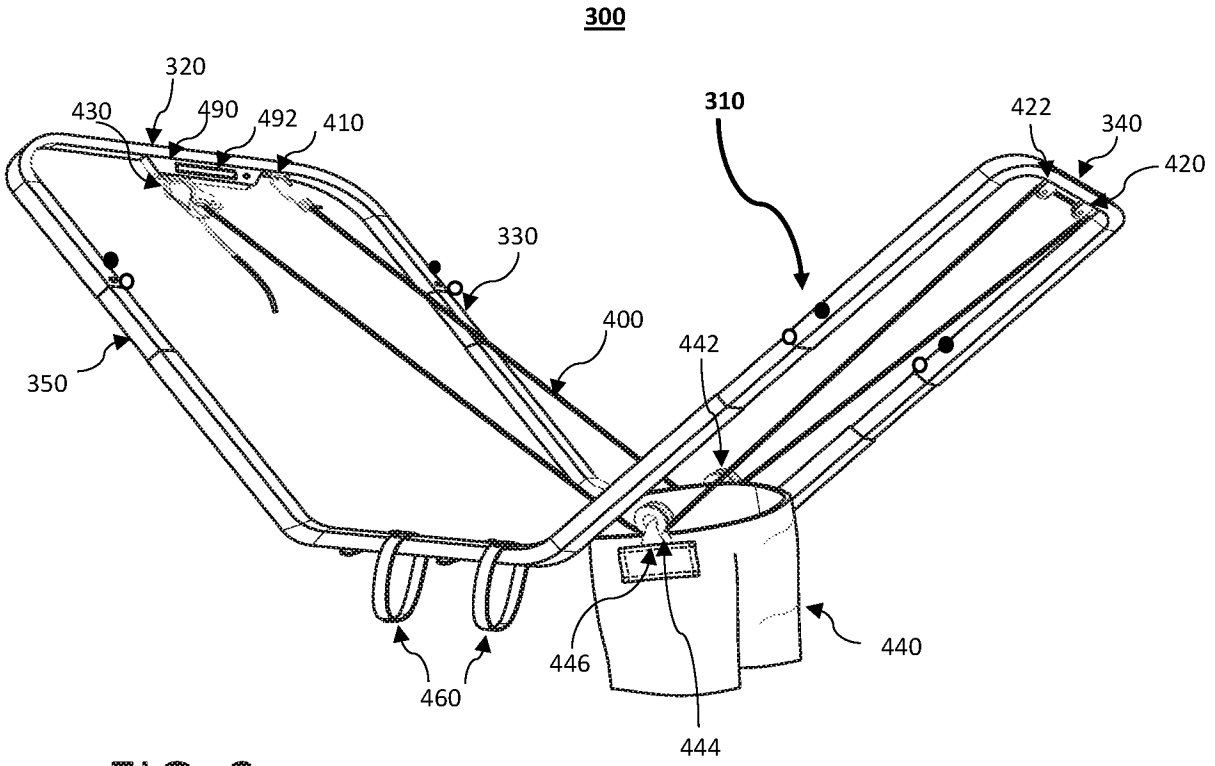
FIG. 3 is an illustrated view of a preferred embodiment of an exemplary treadmill attachment.

Turning now to FIG. 3, an illustrated view of an alternative preferred embodiment of an exemplary treadmill attachment 300 is presented. This preferred embodiment is primarily the same as that shown in FIG. 2, with one difference being in the configuration of the elastic cord's attachment to the rear cross bar. As shown in FIG. 3, the preferred embodiment has two pulley wheels 420 and 422 as points of attachment on the rear cross bar 340. The pulley wheels allow the elastic cord to freely travel from side to side.

As shown in FIG. 3, an elastic cord 400 attaches to the front cross bar 320 at an attachment point 410 where there is an attachment fastener. The elastic cord then passes through a first pulley wheel 442, next passes through a first rear fastener 420 at a first rear attachment point on the rear cross bar 340, then passes through second rear fastener 422 at a second rear attachment point on the rear cross bar, then passes under second pulley wheel 444, and finally passes through the front cross bar 320 attachment point 430 where there is an adjustable fastener for adjusting the length of the elastic cord.

The attachment points shown in FIGS. 2 and 3 are shown as being in fixed locations on the front and rear cross bars. The locations provide for the elastic cord to be located such that the embodiments of the treadmill attachments in FIGS. 2 and 3 will accommodate users of varying statures, including differing body width sizes.

In an alternative embodiment, the attachment points are not at fixed locations on the front and/or rear cross bars, but rather at adjustable locations, such that the attachment points can be moved in or out relative to the cross bars. In the embodiment shown in FIG. 2, the front attachment points/fasteners 210 and 230 could be adjustable with respect to the front cross bar 120, such that they can move from side to side on the front cross bar 120. In the embodiment shown in FIG. 3, the front attachment points/fasteners 410 and 430 could be adjustable with respect to the front cross bar 320, and/or the rear attachment points/fasteners 420 and 422 could be adjustable such that they move from side to side on the rear cross bar 340. Accordingly, either the front 410, 430 or rear 420, 422 attachment points could be adjustable from side to side, or both the front 410, 430 and rear 420, 422 attachment points could be adjustable. In this regard, the width of the elastic cord can be adjusted from narrower to wider. Accordingly, as the adjustable attachment points are moved in on the cross bars, the width of the elastic cord will be narrower, and as they are moved out, the width of the elastic cord will be wider. In this manner, the treadmill attachment can have additional flexibility to accommodate a variety of sizes of users and varying distances between different users' hips.

The treadmill attachment 300 further differs from that shown in FIG. 2 in that it further includes an optional monitor 490. It is to be understood that an optional monitor also may be used with the embodiment shown in FIG. 2 and the other embodiments disclosed herein. The monitor 490 provides a number of functions, which includes showing the effective weight reduction of the treadmill attachment 300. The monitor 490 has a display 492 that displays information from the monitor 490 to a user of the treadmill attachment 300. As the tension on the elastic cord 400 is increased through the fastener 430 with the adjustable rope cam, the effective amount of weight reduction is increased and shown on the monitor 490. Likewise, as the tension on the elastic cord 400 is decreased, the effective amount of weight reduction is decreased and shown on the monitor 490. For example, tensioning the elastic cord 400 might increase the effective weight reduction from zero to 10% weight reduced (90% of body weight) which would be shown on the monitor, while releasing tension on the elastic cord 400 could conversely reduce the effective weight reduction from 10% weight reduced to zero lbs., which likewise would be displayed on the monitor.

In a preferred embodiment, a user can enter his or her actual weight into the monitor, and the monitor can display their effective reduced weight and or percentage of body weight reduction. For example, if a user enters 200 lbs. and experiences an effective weight loss of 20 lbs., the monitor could display an effective weight of 180 lbs.

In addition to displaying the amount of effective weight reduction, the monitor 490 may have functions to monitor other aspects of use of the treadmill attachment 300, such as speed of the treadmill, distance traveled, the user's cadence, number of steps taken, and so forth. The monitor may include circuitry, microprocessors, etc. that allow a number of aspects of use of the treadmill to be tracked for a user. The monitor may incorporate functionality that allows tracking of a user's performance through wired or wireless sensors attached to the runner or detected by the monitor.

Figure 4:
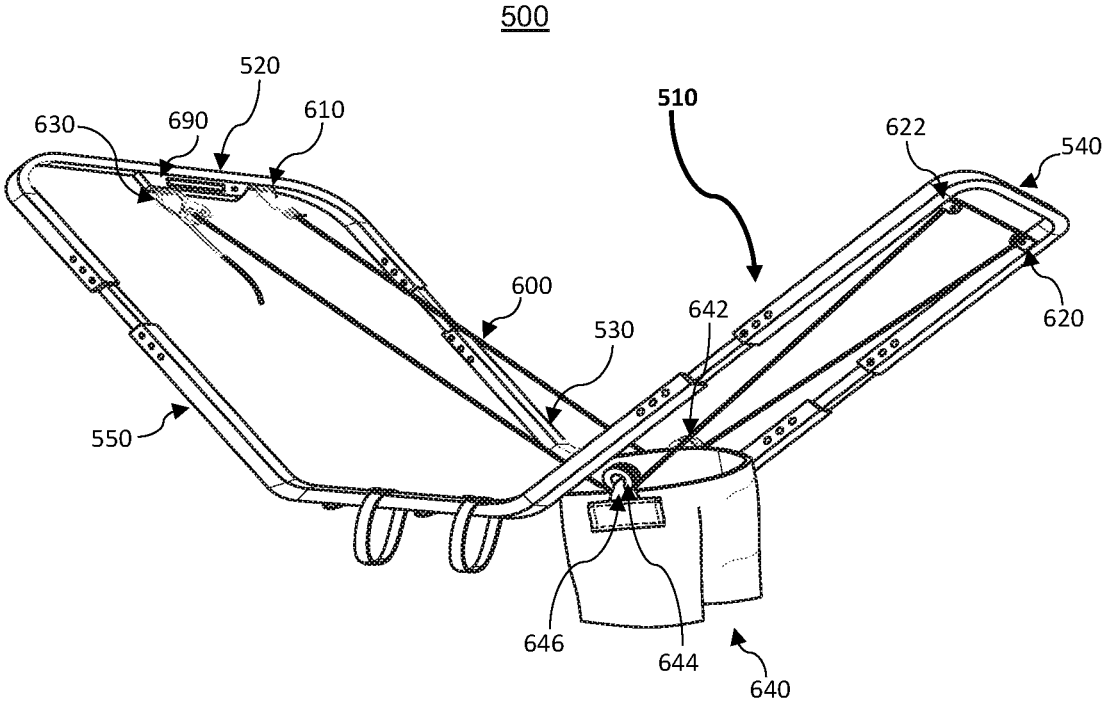
FIG. 4 is an illustrated view of a preferred embodiment of an exemplary treadmill attachment.

Turning now to FIG. 4, an illustrated view of an alternative preferred embodiment of an exemplary treadmill attachment 500 is presented. This preferred embodiment is essentially the same as the treadmill attachment 300 shown in FIG. 3, but the location of the rear pulley wheels 620, 622, to which the elastic cord is fastened to the rear of the treadmill attachment 500 shown in FIG. 4 is different. In treadmill attachment 300 shown in FIG. 3, the rear pulley wheels 420 and 422 are mounted on the horizontal portion of rear cross bar 340. In comparison, the rear pulley wheels 620 and 622 in treadmill attachment 500 shown in FIG. 4 are mounted on the vertical, angled support bars 530 and 550 rather than on the horizontal cross bar 540. Accordingly, the pulley wheels at points 620 and 622 represent an alternative configuration of the rear pulley wheels on the vertical, angled support bars rather than on the rear cross bar. In this alternative configuration the rear pulley wheels continue to allow the elastic cord to freely move and travel from side to side, and the configuration provides for a placement of the rear pulley wheels that accommodates a range of user body/distance between hips widths.

The treadmill attachment 500 shown in FIG. 4 is shown with telescoping angled support bars 530 and 550 that can be adjusted to different heights. In this manner, the treadmill attachment 500 has flexibility with respect to height adjustment of the frame 510 to allow greater variability with respect to treadmills having mounting arms of different heights.

Returning to the exemplary embodiment shown in FIG. 2, the frame 110 of treadmill attachment 100 can be readily assembled from parts such as the cross bars 120 and 140 and the base/support bars 130 and 150. The cross bars 120, 140 and base/support bars 160, 180 can be attached to each other by any number of attachment fasteners/mechanisms. As shown in the nonlimiting embodiment in FIG. 2, the cross bars 120, 140 attach to the base/support bars 130, 150 by sliding into the ends of the base/support bars 130, 150 and then being held in place by a series of locking pins and holes, which allow for rapid, convenient assembly and disassembly of the frame 100 of the treadmill attachment 100. Alternatively, the bars can be held in place with each other by any of a number of fasteners including, but not limited to, screws, nuts and bolts, cotter pins, and so forth Once the treadmill frame 110 is assembled, the suspension system within the frame can be rapidly and easily assembled for use with a user wearing leg garments, such as short 240. For example, one end of the elastic cord 200 can be attached on the front cross bar 120 at point 210. The free end of the elastic cord can then be fed through first pulley 242, then the rear attachment point 220 on the rear cross bar, next through second pulley 244, and finally through attachment point 230 on the front cross bar.

In the alternative, preferred embodiment shown in FIG. 3, the frame 310 of treadmill attachment 300 can be readily assembled as described above for the frame 110 in the treadmill attachment 100. Once the treadmill frame 310 is assembled, the suspension system within the frame can be rapidly and easily assembled for use with a user wearing leg garment 440. For example, one end of the elastic cord 400 can be attached on the front cross bar 320 at point 410. The free end of the elastic cord can then be fed through first pulley 442, then the first rear attachment point 420 on the rear cross bar, next through the second rear attachment point 422, then through second pulley 444, and finally through attachment point 430 on the front cross bar. The pulleys are attached to the leg garment by support straps 446.

The ease by which the presently disclosed treadmill attachment can be assembled enables the treadmill attachment to be readily portable, such that it can easily be transported to a treadmill and then easily and rapidly assembled for use. The treadmill attachment components can be made of lightweight material and sized to further enhance its mobility. For example, the treadmill attachment can be made of materials that include, but are not limited to, aluminum, carbon fiber, steel, and so on. Accordingly, the weight of the treadmill attachment can vary from as little as 2-3 lbs. up to 4-5 lbs., 6-10 lbs., 11-20 lbs., 21-30 lbs., 31-40 lbs., and 41-50 lbs. The ability to manufacture the presently disclosed treadmill attachment such that it weighs 50 lbs. or less, and down to as little as 6-10 lbs., 4-5 lbs. or 2-3 lbs., distinguishes the treadmill attachment from other anti-gravity suspension devices, which weigh considerably more and are not as readily transported. The simple, straightforward convenience of assembly of the presently disclosed treadmill attachment further distinguishes it from other anti-gravity suspension devices, which are more cumbersome and more time consuming to assemble.

In addition to the weight of the components of the treadmill attachment, its mobility and ease of assembly is further contributed to by including parts that are sized for easy assembly and transport. For example, the frame of the treadmill attachment can be assembled from two base/support bars (such as 330 and 350 in FIG. 3) and two cross bars (such as 320 and 340 in FIG. 3), in which the generally V-shaped base/support bars are about 27 inches long and 13 inches deep, and the generally U-shaped cross bars are about 33 inches long and 14 inches deep. Using these preferred dimensions, the entire treadmill attachment can be contained within a bag or similar container that is merely 33 inches long by 15 inches wide and 4 inches deep. Coupling these dimensions with the light weight of the treadmill attachment makes it very mobile, given the treadmill attachment's ease of transport and assembly.

Figure 5:
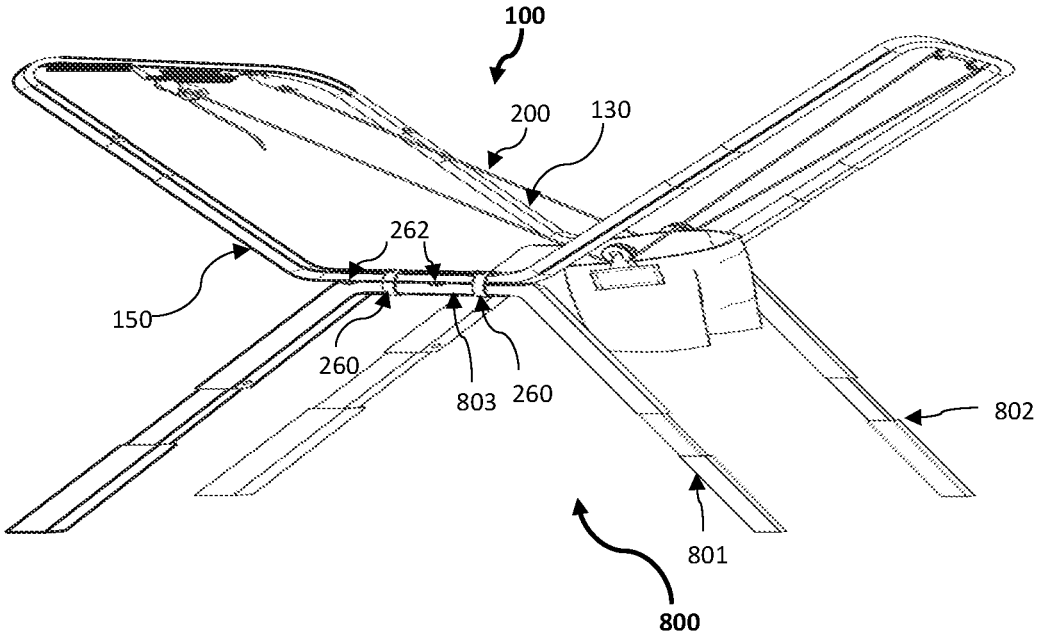
FIG. 5 is an illustrated view of adaptor legs coupled to the exemplary treadmill attachment shown in FIG. 2.

Turning to FIG. 5, an exemplary stand 800 is coupled to the exemplary treadmill attachment 100 shown in FIG. 2. This configuration is designed for use when a treadmill lacks arms or does not have sufficiently positioned and/or sized arms for placing the treadmill attachment on the treadmill's arms. Accordingly, when a treadmill does not have arms, a stand 800 can be used to place the treadmill attachment 100 on or over a treadmill. For example, the stand 800 could be placed on lower edges of the treadmill outside of the moving tread, or entirely outside a treadmill so as to position the treadmill attachment 100 over the treadmill. The stand 800 stabilizes and positions the treadmill attachment 100 at a desired height and position.

The stand 800 as shown in FIG. 5 has a first leg 801 and a second leg 802. Each leg as portrayed has a first angled support bar, a horizontal base bar (803) and a second angled support bar. Each of first leg 801 and second leg 708 are adjustable in height as desired by the user and to accommodate treadmills of varying heights.

The treadmill attachment 100 is configured to lie flat on each of the horizontal base portions 803 of the first leg 801 and second leg 802 of stand 800. Two coupling straps 260 on base/support bar 150 of the treadmill attachment 100 securely and removably attaches to the flat base portion 803 of the first leg 801 of a stand 800. Likewise, two coupling straps 260 (not shown) on base/support bar 130 are securely and removably coupled to the flat base portion 803 of the second leg 802 of the stand 800. The straps 260 can be securely closed and fastened around the legs 801 and 802 of the stand 800 by any of a number of nonlimiting fasteners, such as straps with holes that feed through a buckle, snaps, hook and loop fasteners, and so forth. The straps 260 themselves can be made of any of a number of materials such as, but not limited to, rubber, nylon, and other materials that impart the strength, flexibility, and durability required for the straps 260 to securely hold the treadmill attachment 100 onto the stand 800. The stability of the frame 110 on the legs 801 and 802 of the treadmill is further enhanced by perpendicular flat bars 262 that provide additional, flat surface area of the frame 110 relative to the legs 801 and 802 of the stand 800.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A treadmill attachment designed for effectively reducing an effective weight of a user, the treadmill attachment comprising:

a frame assembly supporting and containing a first cross member and a second cross member;

wherein the first cross member is configured to be positioned above a first end of the treadmill;

wherein the second cross member is configured to be positioned above a second end of the treadmill;

an elastic cord suspended within the frame assembly between the first and second cross members with each end of the elastic cord securely attached to the first cross member, wherein the elastic cord traverses from a first side of the first cross member to the second cross member, and loops back from the second cross member to a second side of the first cross member;

a first pulley wheel suspended by the elastic cord between the first side of the first cross member and the second cross member;

a second pulley wheel suspended by the elastic cord between the second side of the first cross member and the second cross member; and leg apparel that is attached on a first side to the first pulley wheel, attached on a second side to the second pulley wheel, wherein the leg apparel is suspended within the frame assembly by the elastic cord through the first and second pulley wheels.

2. The treadmill attachment of claim 1, wherein the frame assembly is configured to rest on and be fastened to the arms of the treadmill.

3. The treadmill attachment of claim 2, wherein the frame assembly contains a first horizontal base member that lies between a first vertical support member and a second vertical support member;

a second horizontal base member that lies between a third vertical support member and a fourth vertical support member;

wherein the first cross member is connected to and supported by the first and third vertical support members; and wherein the second cross member is connected to and supported by the second and fourth vertical support members.

4. The treadmill attachment of claim 3, wherein the vertical support members are angled support members.

5. The treadmill attachment of claim 3, wherein the treadmill attachment weighs between 2 to 50 pounds.

6. The treadmill attachment of claim 1, wherein the elastic cord is attached to the first side of the first cross member through a first fastener, wherein the first fastener is either a fixed fastener or an adjustable fastener, the adjustable fastener configured to allow a length of the elastic cord to be adjusted;

the elastic cord is attached to the second cross member through one or more second cross member fasteners centered about a center of the second cross member, the one or more second cross member fasteners configured to allow the elastic cord to freely move through the one or more second cross member fasteners;

the elastic cord is attached to the second side of the first cross member through a second fastener, wherein the second fastener is either a fixed fastener or an adjustable fastener, the adjustable fastener configured to allow a length of the elastic cord to be adjusted; and wherein the first and second fasteners on the first cross member are centered about a center of the first cross member and at least one of the first and second fasteners is an adjustable fastener.

7. The treadmill attachment of claim 6 further comprising a monitor configured to display an amount of effective weight reduction of the user.

8. The treadmill attachment of claim 7 wherein the monitor is further configured to display aspects of the user's performance, the aspects selected from the group consisting essentially of number of steps, cadence, speed, distance traveled, and combinations thereof.

9. The treadmill attachment of claim 6, wherein the one or more second cross member fasteners includes at least two rear fasteners attached to the second cross member and have an adjustable location configured to allow the at least two rear fasteners to move from side to side on the second cross member.

10. A treadmill attachment designed for effective body weight reduction, the treadmill attachment comprising:

a frame assembly having a front cross bar; a rear cross bar; a first horizontal base bar; a second horizontal base bar; a first front angled support bar; a second front angled support bar; a first rear angled support bar; and a second rear angled support bar;

wherein a first side support structure is formed by the first front angled support bar, first horizontal base bar, and first rear angled support bar;

wherein a second side support structure is formed by the second front angled support bar, second horizontal base bar, and second rear angled support bar;

wherein the front cross bar is positioned across front ends of the first and second front angled support bars;

wherein the rear cross bar is positioned across rear ends of the first and second rear angled support bars;

an elastic cord suspended within the frame assembly, wherein the elastic cord attaches to a first side attachment point on the front cross bar; travels to the rear cross bar and passes through a center attachment point on the rear cross bar; and then travels to a second side attachment point on the front cross bar;

a legs apparel wearable by a user, the legs apparel having a first side and second side, wherein the first side is coupled to a first pulley wheel and the second side is coupled to a second pulley wheel;

wherein the first pulley wheel is supported by a first side of the elastic cord suspended between the first side attachment point of the front cross bar and the center attachment point on the rear cross bar; and wherein the second pulley wheel is supported by a second side of the elastic cord suspended between the left side attachment point of the front cross bar and the center attachment point on the rear cross bar.

11. The treadmill attachment of claim 10, wherein the first front angled support bar, the first horizontal base bar, and the first rear angled support bar are contained within a single bar structure; and wherein the second front angled support bar, the second horizontal base bar, and the second rear angled support bar are contained within a single bar structure.

12. The treadmill attachment of claim 11, wherein the treadmill attachment weighs between 2 to 30 pounds.

13. The treadmill attachment of claim 10, wherein the elastic cord is attached to the first side of the front cross bar through a first fastener, wherein the first fastener is either a fixed fastener or an adjustable fastener, the adjustable fastener configured to allow a length of the elastic cord to be adjusted;

the elastic cord is attached to the rear cross bar through one or more rear fasteners, the one or more rear fasteners configured to allow the elastic cord to freely move through the first one or more rear fasteners; and the elastic cord is attached to the second side of the front cross bar through a second fastener, wherein the second fastener is either a fixed fastener or an adjustable fastener, the adjustable fastener configured to allow a length of the elastic cord to be adjusted;

wherein the first and second fasteners on the first cross member are centered about a center of the first cross member and at least one of the first and second fasteners is an adjustable fastener.

14. The treadmill attachment of claim 13 further comprising a monitor configured to display an amount of effective weight reduction of the user.

15. The treadmill attachment of claim 10, further comprising at least one adjustable fasteners.

16. The treadmill attachment of claim 15, wherein the at least one adjustable fastener is a rope cam.

17. The treadmill attachment of claim 10, wherein the frame assembly is configured to rest on a first arm and a second arm of a treadmill.

* * * * *